US005366566A

United States Patent [19]

Tournier

[11] Patent Number: 5,366,566

[45] Date of Patent: Nov. 22, 1994

[54] METHOD FOR PREPARING A VERY HIGH QUALITY MAGNETIC MATERIAL

[75] Inventor: Robert Tournier, Bilieu, France

[73] Assignee: Centre National de la Recherche Scientifique, Paris, France

[21] Appl. No.: 730,912

[22] PCT Filed: Oct. 10, 1990

[86] PCT No.: PCT/FR90/00724

§ 371 Date: Jul. 31, 1991

§ 102(e) Date: Jul. 31, 1991

[87] PCT Pub. No.: WO91/05880

PCT Pub. Date: May 2, 1991

[30] Foreign Application Priority Data

Oct. 13, 1989 [FR] France ..... 89 13869

[51] Int. Cl.[5] ..... H01F 1/02

[52] U.S. Cl. ..... 148/103; 148/108

[58] Field of Search ..... 148/103, 108; 156/DIG. 62

[56] References Cited

U.S. PATENT DOCUMENTS 2,686,864 8/1954 Wroughton et al. .

3,887,401 6/1975 Hetzel ..... 148/108

4,950,335 8/1990 Couderchon ..... 148/102

FOREIGN PATENT DOCUMENTS 0293286 11/1988 European Pat. Off. .

59-60737 4/1984 Japan ..... 148/103

1294479 3/1987 U.S.S.R. ..... 148/103

OTHER PUBLICATIONS

Peifer, "Levitation Melting–A Survey of the State of the Art", Journal of Metals. May 1965 pp. 487–493.

Patent Abstracts of Japan, vol. 9, No. 180 (C–293)(1903) Jul. 25, 1985.

*Primary Examiner*—John P. Sheehan

*Attorney, Agent, or Firm*—Lowe, Price, LeBlanc & Becker

[57] ABSTRACT

A method for preparing a sample of a magnetic susceptibility compound $\chi$ comprises the steps of providing a vertical magnetic induction B which has a magnetic induction gradient dB/dz and which is such that B.dB/dz has a sign opposite to that to the weight of the sample and such that the magnetic force $(\chi.B.dB/dz)/\mu_0$ is higher than the weight and heating at a temperature close to the melting temperature.

11 Claims, 2 Drawing Sheets

METHOD FOR PREPARING A VERY HIGH QUALITY MAGNETIC MATERIAL

FIELD OF THE INVENTION

The present invention relates to a method for preparing very high quality magnetic materials, and more particularly solid magnetic materials obtained from a solidification of a liquid phase or a solid diffusion close to melting temperature.

BACKGROUND OF THE PRIOR ART

The manufacturing of very high quality magnetic materials encounters problems which impair the material quality after solidification, among which can be mentioned the influence of the walls and convection phenomena in the liquid phase. These problems are inherent in the coexistence of, on the one hand, composition, temperature or density gradients and, on the other hand, the gravity field. Sedimentation and stratification phenomena also occur in liquids including solid suspensions, or non-miscible liquid suspensions; the heaviest suspensions move downwardly. These various effects are responsible for the lack of homogeneity in composition and defects in the magnetic material after solidification.

To overcome these various problems, it has been proposed to manufacture materials in satellites or during free fall in order to obtain a zero gravity or microgravity condition. But this implies very powerful and expensive means.

SUMMARY OF THE DISCLOSURE

An object of the invention is to provide a method for manufacturing magnetic materials while ensuring in a simple way conditions, partially or entirely similar to those encountered in microgravity.

To achieve this object, the invention provides a method for preparing a sample of a magnetic compound having a magnetic susceptibility $\chi$ comprising the following steps:

a) providing a vertical magnetic induction B which has a magnetic induction gradient dB/dz and which is such that B.dB/dz has a sign opposite to that of the weight of the sample in a selected reference axes and such that the magnetic force $(\chi.B.dB/dz)/_{\mu 0}$ is higher than the weight, and b) heating at a temperature close to the melting temperature.

According to a characteristic of the invention, step (b) is followed by a step consisting in cooling the sample in the presence of the magnetic induction B and magnetic induction gradient dB/dz.

According to a first embodiment of the invention, the sample is heated during step (b) at a temperature higher than the melting temperature.

According to a second embodiment of the invention, the sample is heated during step (b) at a temperature lower than the melting temperature and adapted to enhance the internal diffusions of atoms.

BRIEF DESCRIPTION OF THE DRAWINGS

The foregoing and other objects, features and advantages of the invention will be apparent from the following detailed description of preferred embodiments as illustrated in the accompanying figures wherein.

DETAILED DESCRIPTION OF THE PREFERRED EMBODIMENTS

Figure 1:
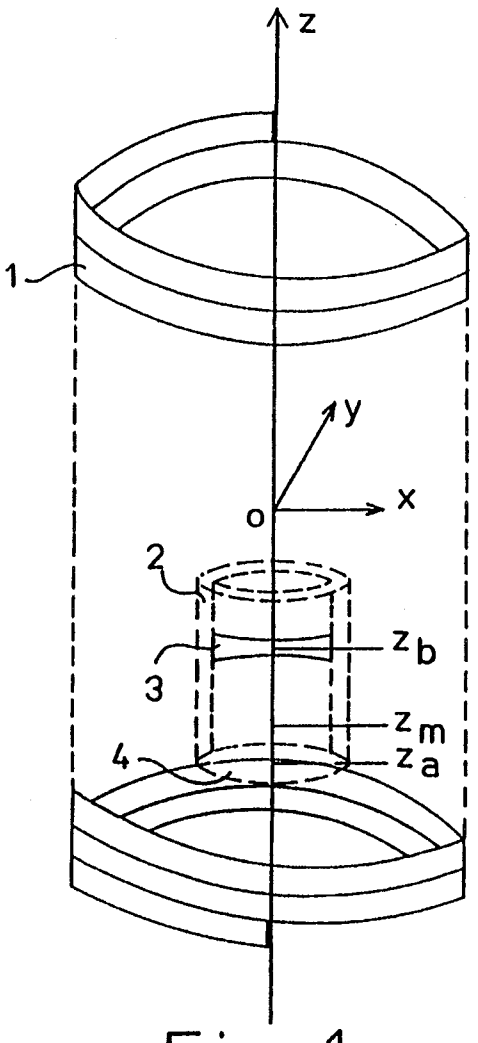
FIG. 1 is a perspective view of an assembly illustrating a first implementation of the method according to the invention.

FIG. 1 shows an assembly illustrating a first embodiment of the method according to the invention. The assembly comprises a coil 1. A system of Cartesian coordinates (x, y, z) has its origin at the center of the coil, equally spaced from its two extremities. The coil is placed so that its axis, which corresponds to the axis z of the reference axes, is oriented along the gravity field, this orientation being hereafter called "vertical".

A cylindrical crucible 2, in which a magnetic material 3 in solid or compact powder form is introduced, is so positioned in coil 1 that the crucible axis is in coincidence with the axis of the coil and that bottom 4 of the crucible is above position z=0. The material initially lies on the bottom of the crucible at a height $-z_a$ $z=z_a$. Crucible 2 can be vertically displaced and is made of a non-magnetic material. An oven (not shown) is provided inside the coil and surrounds the crucible.

First, a current is allowed to flow in the coil for generating a positive magnetic induction in the selected reference system. Intensity B of the induction on axis z is shown as a function of the height z in FIG. 2. The induction has a maximum value at z=0 and progressively decreases as the absolute value of z increases. Thus, there are along the coil axis, for values of z different from zero, on the one hand, a magnetic induction B and, on the other hand, a magnetic induction gradient dB/dz. Away from the z axis, are super-imposed the magnetic induction B, vertical gradient dB/dz and horizontal components of the magnetic induction gradient dB/dx and dB/dy.

Figure 2:
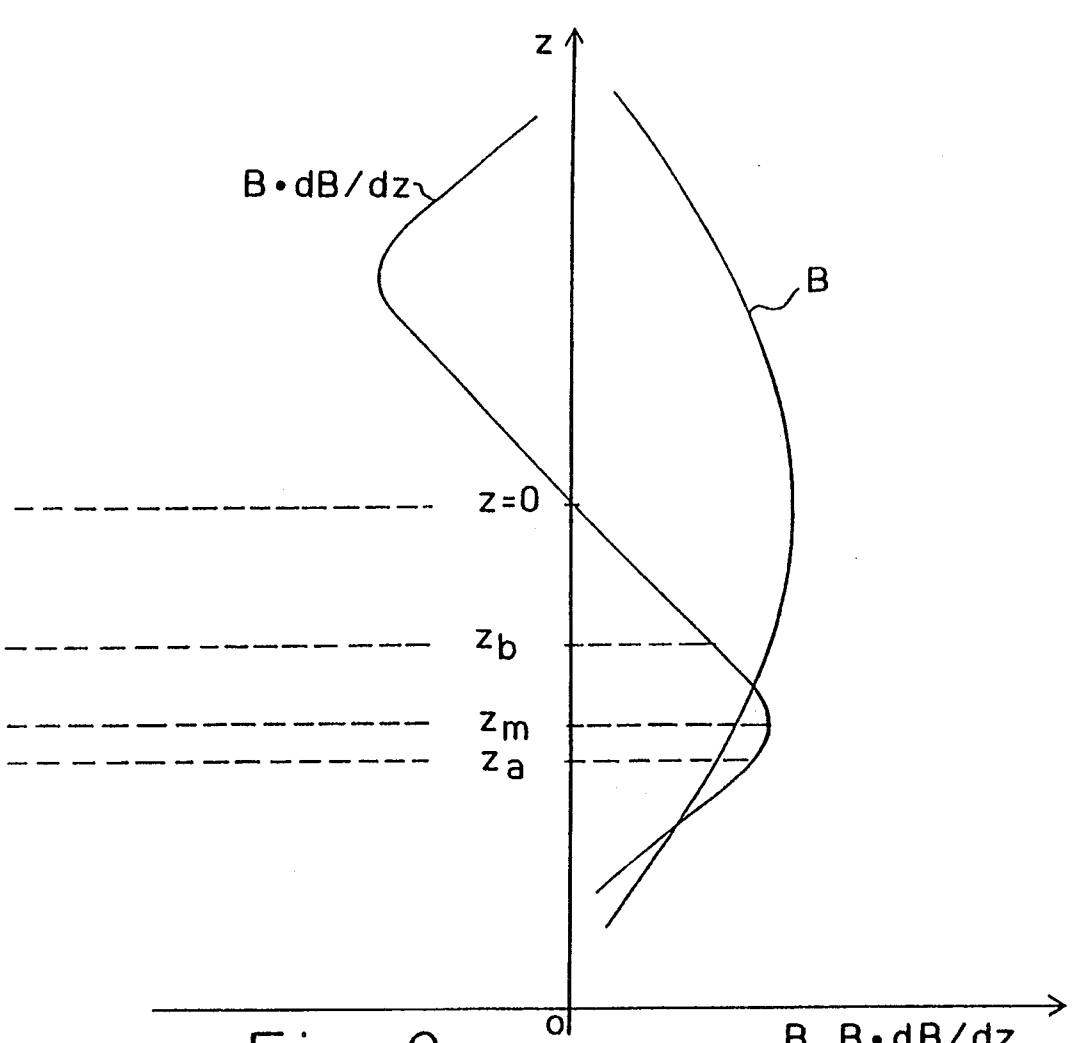
FIG. 2 shows the intensity of the magnetic induction generated by a coil along its axis and the product of the induction by the gradient of this magnetic induction as a function of the position on this axis in the assembly of FIG. 1.

Should the magnetic material have a positive magnetic susceptibility $\chi$, which is the case for a paramagnetic compound, it will be subject, in accordance with electromagnetic laws, to a force $(\chi.B(Z_a).dB(Z_a)/dz)/_{82\ 0}$ ($\mu_0 = 4\pi.10^{-7}$ in International Units—I.U.). The curve representing B.dB/dz is also represented in FIG. 2 as a function of the position z on the coil axis and always has a positive value. For values of z lower than zero, the induction increases as z approaches zero and the induction gradient is positive. Therefore, B.dB/dz and thus the magnetic force $(\chi.B.dB/dz)/_{\mu 0}$ are positive since the magnetic susceptibility is positive. They reach a maximum value for a position $z=z_m$ corresponding to the maximum slope region of the induction curve. For positive values of z, the induction is positive and its intensity decreases as z increases. The gradient is negative. B.dB/dz and therefore the magnetic force $(\chi.B.dB/dz)/_{\mu 0}$ are negative. They reach a second maximum value for a position z corresponding to the negative highest slope region on the induction curve.

In the selected Cartesian reference system, the weight of the material, being a gravity-oriented force, is in the −z direction. Thus, the magnetic force $(\chi.B.dB/dz)/_{\mu 0}$ is opposite to the weight when the force is positive, that is, for values of z lower than zero. If this magnetic force has an intensity higher than that of the weight, the magnetic compound will be raised until the magnetic force and the weight are strictly counterbalanced. FIGS. 1 and 2 show the case when the sample is raised from the position $z_a$ placed beneath the maximum value at $z=z_m$ of the curve B.dB/dz and is stopped at the equilibrium position at $z=z_b$.

During a second step, the sample is heated beyond the melting temperature. Compound z is thus melted and turned into a liquid magnetic compound. FIG. 1 shows the case when the position according to direction z of the compound is practically unchanged after transformation into a liquid. However, the magnetic susceptibility of some materials may substantially decrease when temperature increases. The height of the sample in the crucible then tends to decrease, although B.dB/dz increases. It is also possible to adjust the induction amplitude so that the magnetic force prompts the material in the position $z=z_m$ corresponding to the maximum value of the force.

The presence of a magnetic induction gradient along the direction z implies the presence of induction gradients along the horizontal directions since the relation:

$$div\ B=\delta B/\delta x+\delta B/\delta y+\delta B/\delta z=0$$

has to be complied with. Thus, even when the equilibrium is stable on axis z the horizontal induction gradients generate forces which tend to outwardly deviate the magnetic material located away from the z. The edges of crucible 2 maintain the material close to the central coil axis. The shape of material 3, thicker on the out-side, is caused by the horizontal induction gradients and the resulting forces.

In the above, a paramagnetic compound with a positive susceptibility has been considered. In the case of a diamagnetic material, $\chi<0$, the equilibrium position in levitation state corresponds to a positive value of z, and the horizontal induction gradients now tend to draw back towards axis z the regions of the material external to this axis.

For example, a superconductive coil with multifilaments of niobium-titanium (NbTi) and niobium-tin ($Nb_3Sn$) is used for generating a high magnetic induction of about 12–18 T. The internal diameter of the coil is selected in this particular case slightly higher than one tenth of a meter for H=12 T and 0.05 m for H=18 T. The value of the product B.dB/dz varies from zero for z=0 to a value of 500–2000 $T^2/m$ at a height z of about 0.1 m for a coil positioned in an annular cryostat (not shown) having a free cylinder with a diameter equal to 0.1–0.03 m at normal temperature. With such a value of B.dB/dz, the magnetic compound will be liable to be levitated if $|\chi|\geqq 2.5$ to 0.6 $10^{-8}$ I.U./kg. Those values of $\chi$ correspond to those observed for numerous solid or liquid organic compounds (e.g., water, ice, acetone, ethyl alcohol, some proteins, etc.).

Most elements of the periodic table, and especially rare earths, actinides and transition metals, have at their melting temperature magnetic susceptibilities higher than $2.10^{-8}$ I.U./kg. Holmium, for example, which is a rare earth liable to be included in superconductive materials, has a magnetic susceptibility of $6.2\times10^{-7}$ I.U./kg at a 1,461° C. melting temperature.

Moreover, to set some magnetic materials in levitation condition, it is not necessary to have high magnetic inductions of about ten teslas or more. Compounds such as iron-carbon alloys are liable to be levitated under inductions of 2.3 teslas because the magnetic susceptibility of melt iron is very high, that is, about $3.2\times10^{-7}$ I.U./kg.

Thus, with the method according to the invention, it is possible to obtain a levitation situation in a particularly simple way. Preferably, the material is set in levitation situation during solid or solidified state; then, it is heated and cooled down in the presence of induction and induction gradient. This method thus provides a better composition homogeneity and a decrease in defects for a very large number of magnetic materials, especially those prepared from conductive liquids.

In the specific case of diamagnetic materials, setting the material in levitation condition during solid state, then liquifying it before solidifying it again avoids contact with the crucible walls. Indeed, the liquid drop or macrodrop obtained after melting tends, as seen above, to self-concentrate under the influence of the forces associated with the horizontal field gradients. But, if one starts from the material in liquid state, these forces can be insufficient to overcome wetting forces. By way of example, it will then be possible to treat protein solutions in a solidified liquid (ice) to achieve a protein crystal growth, in a way similar to what is achieved in a space shuttle.

On the other hand, in a liquid with a determined susceptibility comprising a material having an analogous susceptibility, in solid or liquid suspension, the material particles set in levitation situation according to the invention may remain in suspension disregarding their size and weight. Solidification under these conditions may then occur without stratification or sedimentation, whatever be the solubility in the liquid. Therefore, it is possible to obtain compounds comprising precipitates, homogeneously distributed in the matrix.

A further advantage of the invention is that it is possible to achieve in levitation situation a crystal growth or a synthesis of oriented materials provided that the material keeps a magnetic anisotropy at melting temperature, that is, an axis of easy magnetization with respect to the crystal structure. Thus, it will be possible to form, for example, crystals of the $TmBa_2Cu_3O_{7-x}$ type, or very homogeneously oriented polycrystalline compounds, according to the cooling rate.

According to an embodiment of this first application of the method according to the invention, it is possible to apply, in addition to the magnetic induction and magnetic induction gradient, temperature gradients liable to facilitate migrations of particles, bubbles or atoms which lead to a phase separation or a purification and can cooperate to achieve texturation if the direction of growth associated with the temperature gradient is compatible with the one increased by the magnetic field. So, it is possible to obtain an oriented ceramic, an oriented polycrystalline material or bulk crystals.

Figure 3:
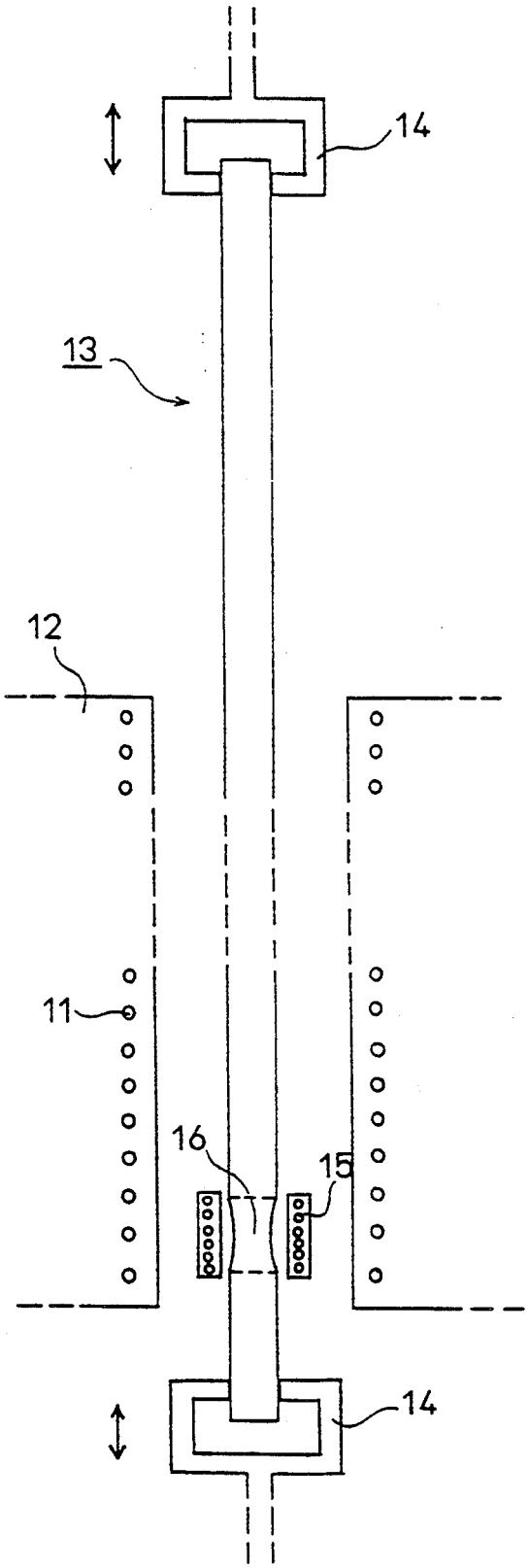
FIG. 3 is a cross-sectional view of another assembly illustrating a second implementation of the method according to the invention.

FIG. 3 is a cross section view of a further assembly illustrating a second application of the method according to the invention. A coil 11 is placed in a cryostat 12. A solid bar 13 of a magnetic material is introduced into the coil so that its central axis substantially corresponds to the vertical coil axis. The bar is held on both sides of the coil by holding means 14 allowing vertically displacement of the ends of the bar upward or downward.

Heating means comprising, for example, by a second coil 15 placed between the bar and the cryostat form, always in the presence of the magnetic induction and magnetic induction gradients, produces a molten (or floating) zone 16 on one edge of the bar. Such floating zones are used for purifying materials and growing crystals. A relative motion of the bar with respect to the heating coil by moving the bar, for example upwardly and downwardly, provides on the whole length more homogeneous materials, the molten zone being set in a levitation situation.

Moreover, in the gravity field, the weight of the liquid causes the molten zone to be deformed and destroyed if the size and weight of the liquid portion increase, because the surface tension holds together only small heights of liquid. Thus, for practically all materials, except for silicon, the height of the molten zone does not exceed about one centimeter for a zone diameter of a few centimeters. In the absence of gravity, the height of the molten zone can reach the value $\pi d$ where d is the diameter of the molten zone. The molten zone volume can thus be very substantially increased, which highly increases the processing and crystal growth efficiency.

Moreover, it is possible with the method according to the invention to invert the levitation and heating steps. Thus, in a first step, it is possible to heat the sample of a magnetic compound to convert it into a liquid and, in a second step, to supply the magnetic induction and magnetic induction gradient to set the liquid in levitation situation.

According to a variant of the method according to the invention, the sample of magnetic compound set in a magnetic induction and magnetic induction gradient is heated at a temperature close to the melting temperature, but lower than this melting temperature, for improving internal diffusions, before cooling down. The transport of material in a levitation situation by means of diffusion permits one to more homogeneously rearrange and distribute atoms. In that case, the sample is liable to be a solid or thin sample of compact or non-compact powder.

Various variants and further modifications will appear occur to those skilled in the art. For example, it is possible to apply lower magnetic inductions and magnetic induction gradients to set a magnetic material in suspension in a liquid in a lower gravity state, which may be sufficient for putting small-weight particles in suspension.

Similarly, for particles such as fibers having a shape anisotropy or particles having a magnetic anisotropy and placed in a liquid, it is known that a magnetic field permits orienting these particles. Setting in levitation according to the invention improves this orientation and permits working with liquid/particle couples for which the difference in density would not normally allow a suspension state.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. A method for preparing a sample of a magnetic compound having a magnetic susceptibility ($\chi$), comprising the following steps:

(a) providing a magnetic induction (B), which has a magnetic induction gradient (dB/dz) along a vertical reference axis z in a Cartesian set of mutually orthogonal reference axes x, y, and z, such that a product ($\chi \cdot B \cdot dB/dz$) of said magnetic induction (B), said magnetic induction gradient (dB/dz) and said magnetic susceptibility ($\chi$) has a direction along said z axis and opposed to the direction of the gravitational force being exerted on the sample so that a magnetic force $(\chi \cdot B \cdot dB/dz)/\mu 0$, where $\mu 0$ is $4\pi \times 10^{-7}$, is at least equal to the gravitational force acting on the sample being also subjected to said magnetic force at a particular point on said vertical reference axis z, and (b) heating the sample.

2. The method according to claim 1, wherein:

the magnetic force acting on the sample is sufficient to overcome the gravitational force and levitate the sample while in a solid state, and wherein the heating step (b) follows step (a).

3. The method according to claim 2, comprising the further step of:

cooling said sample in the presence of said magnetic induction (B) and said magnetic induction gradient (dB/dz) after step (b).

4. The method according to claim 3, wherein:

said sample is heated during step (b) to a temperature which is selected to be higher than a melting temperature of said sample.

5. The method according to claim 3, wherein:

said sample is heated during step (b) to a temperature which is selected to be less than a melting temperature of said sample.

6. The method according to claim 4, wherein:

said magnetic induction (B) and said magnetic induction gradient (dB/dz) are provided by a coil having an axis along the z axis, said sample being contained in a cylindrical crucible made of a non-magnetic material which is positioned inside said coil, with an axis of the crucible also aligned with the z axis.

7. The method according to claim 4, wherein:

said magnetic induction (B) and said magnetic induction gradient (dB/dz) are provided by a coil, said sample being formed in a molten zone obtained by locally heating one portion of a bar of the same material as the sample, an axis of the bar being disposed vertically and along an axis of the coil, and comprising the further step of moving the heated bar inside the coil along the z axis, whereby the molten zone is displaced along the magnetic bar.

8. A method according to claim 6, wherein said sample is a superconductor material containing holmium.

9. A method according to claim 6, wherein said sample is a compound made of an iron-carbon alloy.

10. The method according to claim 6, comprising the further step of:

subjecting said sample to a temperature gradient in addition to the magnetic induction and magnetic induction gradient.

11. A method according to claim 7, comprising the further step of:

subjecting said sample to a temperature gradient in addition to the magnetic induction and magnetic induction gradient.

* * * * *